United States Patent [19]

Baker et al.

[11] Patent Number: 4,690,779

[45] Date of Patent: Sep. 1, 1987

[54] HARD SURFACE CLEANING COMPOSITION

[75] Inventors: Harold R. Baker, Pleasanton; Eugene S. Thrower, Oakland; David C. Simpson, Indio, all of Calif.

[73] Assignee: The Clorox Company, Oakland, Calif.

[21] Appl. No.: 815,664

[22] Filed: Dec. 30, 1985

Related U.S. Application Data

[63] Continuation of Ser. No. 505,038, Jun. 16, 1983, abandoned.

[51] Int. Cl.[4] ..... C11D 1/75; C11D 3/37

[52] U.S. Cl. ..... 252/546; 252/173; 252/174.17; 252/174.23; 252/174.24; 252/174.21; 252/527; 252/528; 252/547; 252/531; 252/532; 252/539; 252/540; 252/550; 252/551; 252/545; 252/526; 252/555; 252/536; 252/558; 252/559; 252/DIG. 2; 252/DIG. 14

[58] Field of Search ..... 252/173, 174.17, 174.21, 252/174.23, 174.24, 527, 528, 546, 547, 531, 532, 539, 540, 550, 551, 545, 526, 555, 536, 558, 559, DIG. 2, DIG. 14

[56] References Cited

U.S. PATENT DOCUMENTS

| | | | |
|---|---|---|---|
| 2,978,416 | 4/1961 | Fein | 252/558 |
| 3,970,594 | 7/1976 | Claybaugh | 252/524 |
| 3,979,339 | 9/1976 | Claybaugh | 252/524 |
| 4,100,094 | 7/1978 | Burns | 252/174.17 |
| 4,126,572 | 11/1978 | Tai | 252/540 X |
| 4,175,062 | 11/1979 | Disch et al. | 252/540 |
| 4,213,873 | 7/1980 | Church | 252/153 |
| 4,242,217 | 12/1980 | Westermann et al. | 252/135 |
| 4,315,828 | 2/1982 | Church | 252/174.21 |
| 4,368,146 | 1/1983 | Arsonson et al. | 252/542 |
| 4,606,842 | 8/1986 | Keyes et al. | 252/174.23 |

FOREIGN PATENT DOCUMENTS

| | | |
|---|---|---|
| 2840463 | 3/1980 | Fed. Rep. of Germany . |
| 2913049 | 10/1980 | Fed. Rep. of Germany . |
| 1566326 | 4/1980 | United Kingdom . |

*Primary Examiner*—Prince E. Willis

*Attorney, Agent, or Firm*—Joel J. Hayashida; Stephen M. Westbrook

[57] ABSTRACT

An improved, substantially non-streaking, aqueous hard surface cleaning composition is disclosed comprising approximately 0.05% to 25.0% by weight of a surfactant selected from anionic, nonionic, amphoteric and cationic/nonionic N-bearing surfactants of up to 30 carbon atoms; approximately 0.05% to 25.0% by weight of an unbranched, straight chain polymer of molecular weight less than 5,000; approximately; 0.05% to 25.0% by weight of an aqueous solvent of the general structure $R\text{-}(CH_2)_xOH$ where R is selected from the group consisting essentially of H, alkyl, aryl, aroxy or alkoxy, wherein X is an integer from 1 to 10; a builder; and the remainder as water.

The unbranched, straight chain polymers are preferably selected from the group consisting of polyethylene glycol, polyvinyl pyrrolidone, methyl hydroxy propyl cellulose, or polyacrylic acid.

Cleaning adjuncts selected from the group consisting of dyes, fragrances, pH adjusters, and antimicrobially active compounds may be added.

2 Claims, No Drawings

HARD SURFACE CLEANING COMPOSITION

This is a continuation of application Ser. No. 505,038 filed June 16, 1983, now abandoned.

BACKGROUND OF THE INVENTION

There are numerous, commercially available hard surface cleaning compositions available in the prior art. Generally, they consist of some small percentage of surfactant, such as a nonionic or anionic surfactant, a solvent, such as some straight-chain, simple alcohol, or ammonium hydroxide, a builder, and water. A perfume may be added to impart a pleasant fragrance to the composition, as well as to mask the unpleasant odor of the solvent and/or surfactant, and, perhaps, a dye to impart a pleasant color to the cleaning composition. However they have had limited cleaning efficiency with respect to particular types of soils, and are subject to streaking or redepositing of soil on the surface. Many cleaners are also very substantive on the surface to which they are applied, thus necessitating many passes with a cleaning cloth, paper towel or other sorbent to remove the cleaner. Still other cleaners may be too viscous, which may cause film-forming, or difficulty in discharge from the container for use. There is thus a need for a substantially low streaking or low film forming cleaner without having undue viscosity.

In an attempt to solve these problems some prior art has suggested the use of various organic polymers in formulations that include surfactants and solvents as referred above. Church, U.S. Pat. No. 4,213,873 ("Church I"), and Church, U.S. Pat. No. 4,315,828 ("Church II") proposed the use of relatively high molecular weight polyethylene glycol or methoxypolyethylene glycol polymers as lubricants in a cleaning composition containing an ammonium hydroxide or monohydroxy alcohol solvent. However, the two Church patents relate directly to cleaning of glass and chrome surfaces, and the formulations therein are peculiarly adapted to such surfaces and do not relate to the cleaning compositions of the present invention.

Apparently, however, in order to prevent streaking, the Church I and Church II compositions, after application, must be very thoroughly wiped from the surface treated so as to cause sufficient wicking action to draw the cleaning composition and loosened soil into the cleaning cloth. Otherwise, a residue will remain which, according to the Church I and Church II descriptions, may be easily wiped up.

Further, the Church I and Church II compositions are limited in the types of solvents which may be used in their formulations. In most instances, only such cleaning agents as lower boiling point alcohols and very limited amounts of higher boiling point solvents can be used in the Church I and Church II formulations.

Further, in other hard surface cleaners, where higher molecular weight polymers have been used, increased cost is a disadvantage.

DISCLOSURE OF THE INVENTION

This invention relates to a substantially non-streaking, hard surface, aqueous cleaning composition and a method for cleaning hard surfaces comprising:

(a) approximately 0.05% to 25.0% by weight of a surfactant selected from anionic, nonionic, amphoteric and cationic/nonionic N-bearing surfactants;

(b) approximately 0.05% to 25.0% by weight of an unbranched, straight chain polymer of molecular weight less than 5,000;

(c) approximately 0.05% to 25.0% by weight of an aqueous solvent of the general structure $R—(CH_2)_xOH$ wherein R is selected from the group consisting essentially of H, alkyl,aryl, aroxy and alkoxy, wherein x is an integer from 1 to 10;

(d) approximately 0.05% to 25.0% by weight of builders; and (e) The remainder as water.

In another embodiment of this invention, the unbranched, straight chain polymers of molecular weight less than 5,000 of (b) are selected from the group consisting of polyethylene glycol, polyvinyl pyrrolidone, polyacrylic acid, and methyl hydroxy propyl cellulose.

In still another embodiment of this invention, a sixth component (f) comprising approximately 0% to 25.0% cleaning adjuncts selected from the group consisting of dyes, fragrances, pH adjusters and antimicrobially active compounds may be added.

In a further embodiment of this invention, the improved, substantially non-streaking, aqueous hard surface cleaning composition comprises water and selected cleaning adjuncts, wherein the improvement further comprises the addition of:

(a) approximately 0.05% to 25.0% by weight of a surfactant selected from:

An anionic surfactant of the general structure $$R\ (OCH_2CH_2)_nOSO_3M$$

wherein R is $C_{5-20}$, n (degree of ethoxylation) is 1 to 10, and M is Na, K, Li, NH or amine; an anionic surfactant of the general structure

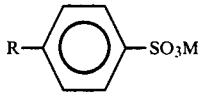

wherein R is $C_{10-20}$ and M is H, Na, K, Li, $NH_4$, Ca, or substituted primary amine; a nonionic surfactant of the general structure

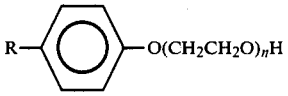

wherein R is $C_{5-20}$ and n averages 0 to 20; a nonionic surfactant of the general structure $$RO\ (CH_2CH_2O)_nH$$

wherein R is $C_{5-20}$ and n averages 0 to 20; an amphoteric surfactant of the general structure

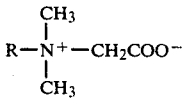

wherein R is $C_{0-20}$; and a cationic/nonionic surfactant of the general structure

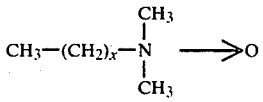

wherein X is up to 30; and (b) approximately 0.05% to 25.0% by weight of an unbranched, straight-chain polymer of molecular weight less than 5,000 selected from the group consisting essentially of polyethylene glycol, polyacrylic acid, methyl hydroxy propyl cellulose, and polyvinyl pyrrolidone.

DETAILED DESCRIPTION OF THE INVENTION

In the soiled surfaces sought to be cleaned by the present invention, soil includes oily, greasy, tarry, and other oleaginous soiling materials, as well as dust and dirt. In many cases, a certain composition may have extremely good cleaning qualities but leave undesirable residues resulting in smears or films comprising the soiling material, the cleaning composition, or a combination of the two. In other cases, compositions may have fairly good non-streaking characteristics for certain soils, but not clean other soils acceptably. In still other cases, some cleaners have an unacceptably high amount of viscosity, causing problems heretofore discussed.

It has been found that improved cleaning as well as excellent non-streaking and non-filming in comparision to a standard formula without surfactant, using a minimum of wiping and with desirable viscosity, is achieved with a composition comprising a combination of a surfactant selected from anionic, nonionic, amphoteric and cationic/nonionic N-bearing surfactants and a specific class of low molecular weight polymers.

A. Surfactants

It was found that a suitably effective surfactant may be selected from:

1. Anionic Surfactants: Suitable anionic surfactants, whose hydrophilic moiety in aqueous solutions is negatively charged, include:

N-acyl sarcosinates having the general structure:

R $CON(CH_3)CH_2$ COO M, wherein R is alkyl averaging 10 to 20 carbons ($C_{10-20}$) and M is Na, K or Li, $NH_4$ or amine;

Sulfonates such as straight-chain, alkylbenzene sulfonates (HLAS and LAS), with the general structure:

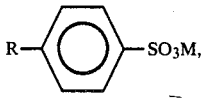

wherein R is alkyl averaging 10 to 20 carbons ($C_{10-20}$), M is H, $NH_4$, Na, K, Li, Ca, or substituted primary amine. Particularly preferred surfactants in this invention are selected from the sodium salts known as "LAS," wherein R is alkyl averaging 10 to 14 carbons ($C_{10-14}$) and is called sodium lauryl benzene sulfonate or sodium dodecyl benzene sulfonate.

N-Acyl-N-Alkyl taurates having the general structure:

R $R^1$ $NCH_2$ $CH_2SO_3$ M wherein R is acyl or alkyl averaging 10 to 20 carbons ($C_{10-20}$), and when R is acyl, $R^1$ is alkyl, and M is $NH_4$, Na, K or Li; and αOlefin sulfonates including, but not limited to, mixtures of the structures:

$R^1$ CH: CH $(CH_2)_x$ $SO_3$ M, wherein $R^1$ is alkyl averaging 10 to 20 carbons($C_{10-20}$), M is $NH_4$, Na, K or Li, and X is 0 to 11;

R $CH_2CHO$ $HCH_2CH_2SO_3M$, wherein R is alkyl averaging 10 to 20 carbons ($C_{10-20}$), M is $NH_4$, Na, K or Li; and R CHO $HCH_2CH_2SO_3$ Na, wherein R is alkyl averaging 10 to 20 carbons ($C_{10-20}$);

Sulfates, such as alkyl sulfates of general structure:

R $OSO_3$ M, wherein R is alkyl averaging 10 to 20 carbons ($C_{10-20}$), and M is $NH_4$, Na, K or Li; fatty acid sulfates averaging 10 to 20 carbons ($C_{10-20}$) in the alkyl group, and alkali metal salts thereof selected from Na, K or Li;

Sulfated alkanolamines of the general structure:

R CO NH $CH_2$ $OS_3$ M, wherein R is alkyl averaging 10 to 20 carbons ($C_{10-20}$) and M is $NH_4$, Na, K or Li;

Sulfated esters, such as represented by the general structure: $CH_3$ $(CH_2)_7CH_2CH$ $(OSO_3Na)$ $CH_2$ $(CH_2)_5CH_2COOR$ wherein R is ethyl, propyl, butyl, or amyl group;

Ethoxylated, sulfated alkylphenols of the general structure:

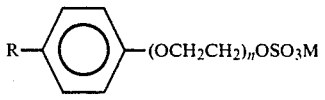

wherein R is alkyl averaging 10 to 20 carbons ($C_{10-20}$), n (degree of ethoxylation) averages 1–10, M is $NH_4$, Na, Li, K or amine;

Alkyl ether sulfates (ethoxylated, sulfated alcohols) of the general structure:

R $(OCH_2CH_2)_n$ $OSO_3M$ wherein R is alkyl of 5 to 20 carbons ($C_{5-20}$), n (degree of ethoxylation) averages 1–10, and M is $NH_4$, Na, Li, K or amine;

Particularly preferred anionics are the alkyl ether sulfates wherein M is Na and R is alkyl averaging 12 to 14 carbons ($C_{12-14}$) with the degree of exthoxylation (n) averaging 1 to 6.

2. Nonionic Surfactants: Nonionic surfactants having virtually no charged species in aqueous solution suitable to this invention include:

Ethoxylated Alkylphenols (alkylphenoxy polyoxy ethanols) having the general structure

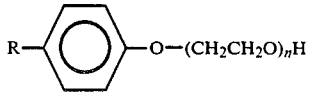

wherein R is alkyl averaging 5 to 20 carbons ($C_{5-20}$), and n (degree of ethoxylation) averages 0–20, are especially preferred surfactants. Where R is alkyl averaging 10 to 14 carbons ($C_{10-14}$) and n averages 9, a particularly preferred surfactant is nonylphenoxy polyoxy ethanol (polyoxyethylene nonyl phenyl ether), sold under the brand name Triton N-101 by Rohm and Haas. Other nonionics are suitable for use and include, but are not limited to, ethoxylated aliphatic alcohols, and carboxylic acid esters.

Suitable ethoxylated, aliphatic alcohols include those with the general structure $$RO(CH_2CH_2O)_nH$$

wherein R is either a straight or branched chain alkyl averaging 5 to 20 carbons ($C_{5-20}$) and n (degree ethoxylation) averages 0 to 20. Especially preferred are the ethoxylated alcohols sold by Shell Oil under the brand name Neodol. A good example is a $C_{12-15}$ alcohol ethoxylate averaging 9 moles of ethylene oxide per mole of alcohol called Neodol 25-9.

3. Amphoteric Surfactants: These surfactants containing both basic and acidic hydrophilic moieties include such amphoterics as alkyl betaines of the general structure

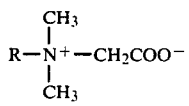

wherein R is alkyl averaging 10 to 20 carbons ($C_{10-20}$).

Particularly preferred are, in the above structure, where R averages 10 to 14 carbons ($C_{10-14}$) The surfactant is a coco amidobetaine sold under the trademark Lonzaine by Lonza Corporation. Other amphoterics include, but are not limited to N-coco-3-amino propionic acids and their alkali metal salts.

4.Cationic/Nonionic Surfactants: Particularly preferred are cationic/nonionic N-bearing surfactants selected from the group of N, N, N,—trisubstituted amine oxide surfactants. It may be preferred to employ amine oxide surfactants of up to 20 carbon atoms. These amine oxide surfactants are representative cationic/nonionic compounds. The amine oxide surfactants displayed excellent cleaning and also proved to leave substantially no residue on the surface cleaned.

As tertiary amine derivatives, they can be easily formed from tertiary amines by mild oxidation, eg., reaction with $H_2O_2$, and can be reduced back to tertiary amines by a number of reagents, such as $PCl_3$ or hydrogen and palladium.

Representative amine oxide structures are set forth below, but by no means meant to restrict the surfactants used herein to those particular structures:

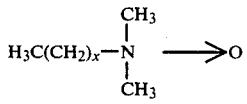

where X = up to 30 or

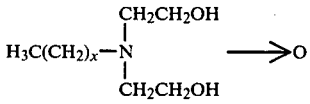

where X = up to 30

When X=11 in the first structure, one of the preferred amine oxides of the invention is lauryl dimethyl amine oxide, which is sold by Baird Chemical Industries, Inc., under the brand name "Barlox 12."

Other cationic/nonionic surfactants may also be effective in formulations of this invention. However, most cationic surfactants appear to comprise relatively strong cationic moieties when dispersed in acidic media, which may be responsible for surfactancy On hard water stains, mineral stains, etc. Most nonionic surfactants, on the other hand, have essentially no charge when dispersed in alkaline or neutral aqueous media, and are more effective on greasy soil/stains. Thus, the amine oxide surfactants utilized herein may owe their uniquely effective cleaning characteristics due to their mixed cationic/nonionic species.

The above particular surfactants have been found to be particularly effective soil removers in combination with the polymers described herein below.

A range of 0.05%–25.0% by weight of these depicted surfactants appears preferred, but is not critical.

B. Polymers

The specific polymers used herein are straight-chain, unbranched polymers of molecular weight below 5,000. It should be noted that the term "branched polymer" does not refer to linear polymers containing side groups as part of the monomer structure. (See, eg., structure of polyvinyl pyrrolidone, below). Only polymers containing side branches composed of complete monomer units are termed "branched polymers," and these latter polymers are not included in this invention.

The polymer molecular weight limit of less than 5,000 is critical in this invention. Combinations of these low molecular weight polymers with the surfactants described above are responsible for the surprisingly good results in cleaning, minimal streaking and low viscosity in this invention. Results using higher molecular weight polymers have been shown (see TABLES I & II, below) to lack such improved cleaning results overall.

The preferred polymers of this invention are selected from the group consisting of polyethylene glycol, polyacrylic acid, methyl hydroxy propyl cellulose, and polyvinyl pyrrolidone. Other polymers below 5,000 molecular weight appear feasible in this invention. Certainly the widely diverse group of preferred polymers shows that the polymers of this invention do not appear limited to the type of substituents, charge densities, linkages, or manner of preparation.

Polyethylene glycol is prepared in a known manner by subjecting ethylene glycol to a polycondensation process. Thus, polyethylene glycol may be regarded as the condensation polymer of ethylene oxide or ethylene glycol with water. The general structure is: $HO—(—CH_2—CH_2—O)_n—H$.

Polyacrylic acid is a polymer of acrylic acid with the general formula:

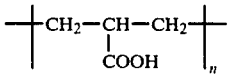

Methyl hydroxy propyl cellulose is a cellulose ether polymer (cellulose=glucose linked by $\beta$1, 4 glycosidic linkages) having the following structure:

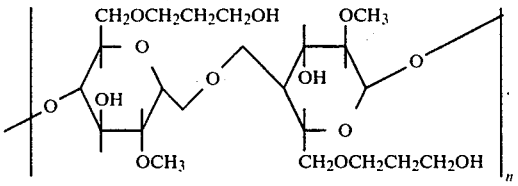

Polyvinyl pyrrolidone has the general structure.

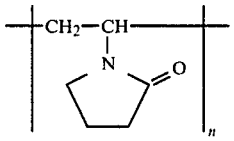

and is also commercially available and marketed under the trademark "LUKISKOLE" ® by Badische Anilin Soda Fabrik (BASF), among others.

As indicated further below in TABLE II, viscosity of the compositions may depend on the molecular weight of the polymer used. The higher the molecular weight, apparently, the higher the viscosity. In this invention, high viscosity cleaning compositions are undesirable, as less substantive cleaners are preferred.

Other low molecular weight polymers which may give cleaning results coming within the scope of this invention may be used. A range of 0.05%-25.0% by weight of these polymers may be added to the formulations of this invention. It is, however, preferred to use at least 0.10% by weight formulation for best results.

C. Solvents

Solvents used in the present invention have the general structure R $(CH_2)_XOH$, wherein R is selected from the group consisting of H, alkyl, aryl, aroxy and alkoxy and x is an integer from 1 to 10:

From these R substituents, it was found that alkoxy of the formula $$CH_3(CH_2)_{x1}—O—$$

wherein $X_1$ is 0 to 6, was preferred. Isomers of these alkoxy's are also included in this invention, such as:

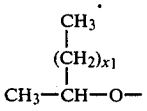

Further, when $X_1$ is 0 to 6, X is preferably 1 to 6. In one preferred example, 2-butoxy ethanol (Butyl cellosolve) was selected. Its structure is:

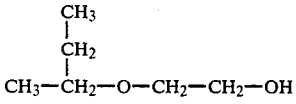

Other solvents which may contribute to the cleaning results coming within the scope of this invention may be used. A range of 0.05% to 25.0% by weight of these solvents may be added to the formulations of this invention, although this may not be critical.

D. Builders

Under the present formulation, builder salts may be necessary in order to: (1) adjust pH (increase alkalinity); (2) improve soil removal, caused by aiding suspension of removed soil; (3) act as a water softener, complexing heavy metals present in hard water, and (4) regulate viscosity. These builder salts may be either inorganic or organic compounds.

Viscosity, however, also appears to be a function of the polymers chosen in the formulation of this invention. For instance, it has been found that some higher molecular weight polymers will cause visibly higher viscosity than lower molecular weight polymers. Such high viscosity is not desirable in the cleaning compositions of this invention Typical inorganic builders include alkali metal salts of various anions, such as soda ash (sodium carbonate), which may further regulate the pH of the formulations of this invention. Many sodium and potassium salts are typical builders which may be used in the formulations. Representative anions may include carbonates, phosphates, silicates, etc.

Organic builders include alkali metal salts of certain amino-carboxylic acids, amine salts of polycarboxylic acids, such as nitriloacetic acid, and di- and polyphosphoric acids. Further examples include citric acid, tartaric acid, tetrahydrofuran and other carboxylic acids. Particularly preferred are sodium salts of ethylene diamine tetaacetic acid, such as tetrasodium ethylene diamine tetraacetate ($Na_4EDTA$). Builders should preferably be present in an amount between approximately 0.05% to 25.0% by weight.

E. pH Adjusters pH values are preferably in the neutral to alkaline range under the formulations of the present invention. Especially preferred are pH values of at least 8. Towards this end, sodium hydroxide is used. Other alkali metal salts of hydroxides may be suitable for use, for example, lithium hydroxide, or potassium hydroxide. Preferably, about 0.05 to 10.0% by weight is added.

F. Adjunct Ingredients

Optionally, fragrances; dyes and pigments, preferably which do not substantially deposit on hard surfaces; bleaches, such as sodium hypochlorite, or other solutions of alkali metal salts of hypochlorites, antimicrobial agents; and buffering agents, etc., can be added. These adjunct ingredients may only be limited in their application to a particular type of hard surface cleaning. For example, some dyes, such as the anthraquinone dyes with the general structure:

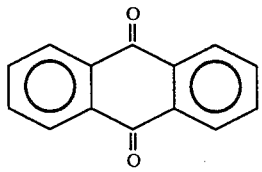

would be inapt for use on grout or other somewhat porous hard surfaces as it would, in formulas disclosed herein, tend to settle and stain such surfaces.

E. Water

As expressed in the broadest disclosure of this invention, water is the principle, inert ingredient. Depending on the formula utilized, it can be present in the compositions of this invention in amounts as great as 99.9% to as low as 50.0%. Optimally, the largest portions of the formulas of this invention contain over 75% water since it will be obviously economically advantageous to lessen the amount of polymer, surfactant, solvent, etc. in the formulas.

Testing Methods

Numerous formulations of the proposed hard surface cleaning composition were tested for soil removal and the amount of effort required to remove soil from hard surfaces. The tests were the (modified) Sanders/Lambert Urban Soil Test, and the Military Specification Test ("Mil. Spec."). Further, the amount of streaking or residue remaining on the surface thus cleaned was measured by reflectance means according to protocol established in the Streaking Method Test. Finally, the formulations were tested for viscosity. These tests are set forth below in TESTS 1–4.

The protocol in TEST 1—Hard Surface Cleaning Performance—modified Sanders & Lambert Soil, describes a procedure for predicting the relative differences in cleaning performance of no-rinse, undiluted hard surface cleaners using a modified Sanders & Lambert Urban soil. This specifically measures the number of strokes oscillations) required to remove the soil from a hard surface, and thus is a function of effort required to remove cleaning compositions of this invention from a given hard surface.

TEST 1

HARD SURFACE CLEANING PERFORMANCE - MODIFIED SANDERS & LAMBERT URBAN SOIL

This standard industry method utilizes artificial soil (modified Sanders & Lambert Urban Soil). Revisions in this procedure include the use of a single soil suspension batch for a test series, new soil application techniques, and scrubbing to a complete soil removal end point. These changes give apparent improvement in the reproducibility of the results and the convenience of implementing the test. Values were obtained for various formulas and reported in TABLES I-III.

TEST DESCRIPTION

A household type soil (modified Sanders & Lambert Urban Soil) is first prepared dry and applied in an oil-water emulsion to Marlite test panels. After curing two hours at 103° C., the Marlite panels are washed by a Gardner Wear Tester (GWT), which is equipped with a 450 gram ("g") weight and fitted with a damp sponge until the soil is removed. The average number of oscillations required for each test product are compared.

The following procedure in TEST 2, Hard Surface Cleaning Performance - Military Soil, permits the evaluation of liquid hard surface cleaners with specified degrees of repeatability and reproducibility. The results are measured in percent of soil removal ("% S.R.") and permits an accurate assessment of how much soiling material can be removed using the single application cleaning compositions of this invention.

TEST 2

HARD SURFACE CLEANING PERFORMANCE-MILITARY SOIL

TEST DESCRIPTION

This standard industry method consists of the application of synthetic particulate soil to dull white marlite panels using a Bird Film Applicator manufactured by Gardner Laboratories. Soil removal is accomplished by using a Gardner Laboratories Heavy Duty Weartester and a damp sponge. A quantitative measure of the Soil Removal (% SR) is determined using a Photovolt Reflectometer. The test basically compares a clean panel as a standard, a soiled panel, and a panel which has had soil removed with the particular cleaning formula chosen. Values were obtained for various formulas and reported in TABLES I–III.

CALCULATIONS

1. Using the three reflectance values, $R_o$, $R_s$, $R_w$, the tests for either % Cleaning Efficiency or % Soil Removal are calculated using the following formulas:

$$\text{Cleaning Efficiency } (\%\ C.E.) = \frac{R_w}{R_o} \times 100$$

$$\%\ \text{Soil Removal } (\%\ S.R.) = \frac{R_w - R_s}{R_o - R_s} \times 100$$

In both formulas, $R_o$ is a clean standard, $R_w$ is the averaged cleaning improvement, and $R_s$ is the reading for a soiled panel. The typical industry test method in TEST 3, Streaking Test Method, is designed to enable an evaluation of hard surface spray cleaners on the basis of the amount of residue after use, as measured by change in gloss. Its value lies in the fact that visual residue often connotes failure to clean. The purpose of this method is to compare hard surface spray-and-wipe cleaners through evaluation of their streaking tendencies. The results are measured in terms of change in reflectance ($\Delta R$), wherein $\Delta R$ values obtained from the surface after treatment which are much higher than the standard, or untreated surface are undesirable. The method of evaluation is detailed in the following procedure.

EXAMPLE 3

STREAKING TEST METHOD

TEST DESCRIPTION

Clean, black ceramic tiles are sprayed with formulas of this invention and wiped, using the Gardner Laboratories Weartester to simulate consumer use. The change in gloss is evaluated by Gardner Glossmeter measurements.

PROCEDURE

1. When the tiles are dry, their reflectances are read and recorded using the Gardner Multi-Angle Glossmeter (20 degree angle), orienting the tiles in the same manner as for the initial reading.
2. The difference between initial and final reflectance values ($R_F$-$R_I$) are calculated for each tile and recorded as the change in reflectance values, $\Delta R$.
3. The change in reflectance values for the tiles are then averaged.

TEST 4

VISCOSITY

Viscosity, as heretofore discussed, may be problematic to hard surface cleaners of this invention. In some cleaners, notably those incorporating abrasive granules or other abradents, a higher amount of substantivity to the surface treated is desirable. In the present invention, however, high viscosity is undesirable, as the hard surface cleaners encompassed within this invention should be free-flowing and relatively nonsubstantive to the surface to which it is applied.

Viscosity is measured as a ratio of the shear stress of given fluid to its shear rate. Shear stress is the force per unit area required to produce shearing action, or differential rates of velocity of the fluid layers. Shear rate, on the other hand, is a measure of the speed at which fluid layers move with respect to each other.

The classical Newtonian formula to describe this relationship is:

$$\frac{F}{A} = \eta \frac{dv}{dx}$$

where $\eta$ is a constant for a given material and is called its "viscosity," F is the force measured, in dynes, A is the unit area measured, in centimeters squared ($cm^2$), dv/dx is a measure of the speed at which differential fluid layers move with respect to each other, and measured in 1/sec.

This equation can be simplified to:

$$\eta = \frac{F^1}{S},$$

where $F^1$ = shear stress ($dynes/cm^2$), $$S = \text{shear rate}\left(\frac{1}{\text{sec.}}\right) \text{ and}$$

$\eta$ = viscosity ($dynes/cm^2/sec.$ = centipoises).

Viscosity is easily and accurately measured by using a viscometer. One example of a viscometer suitable for use in this regard is a Brookfield Engineering Laboratories Viscometer.

To measure viscosity, the following materials are required:

1. Brookfield Engineering Laboratories Viscometer
2. No. 1 spindle
3. 250 milliliter beaker All of the testing of formulas in TABLE II below, were performed at the following constants:

Temperature: 24.6° C.

Viscometer Rotational Speed: 100 revolutions per minute (RPM)

On a standard Brookfield Viscometer Model RVT direct machine readings of fluids measured at 24.6° C., at 100 RPM, using a number 1 spindle, can be directly converted to centipoises, multiplying by a factor of 1.

Thus, in the ensuing Examples listed in TABLE II, below, viscosity ($\eta$) is directly calculated in centipoises.

EXAMPLE 1, below, shows the base formula for one of the preferred embodiments of this invention:

EXAMPLE 1

Base Formula 3.0% 2-butoxyethanol (Butyl Cellosolve)
0.42 lauryldimethylamine oxide
0.67 $Na_4$ EDTA
0.15 NaOH
Balance $H_2O$ To this base formula in EXAMPLE 1, were added various amounts of the preferred polymers of this invention, shown in TABLES I-II. The cleaning efficiency as measured by percent soil removal, non-streaking, and number of strokes required to remove formulation of the resulting formulations were tested and the results are tabulated in TABLE I - II. The viscosity of these formulations are noted as well in TABLE II.

The effect of adding the polymers in these formulations was tested for improved soil removal and overall, added detergency. A wide range of molecular weights was tested, but in the interest of cost effectiveness, lower molecular weight polymers were specifically scrutinized. Here, among others, polyethylene glycols with molecular weights below 5,000 were used. Other polyethylene glycols as well as polyacrylic acid and methyl hydroxy propyl cellulose of higher molecular weights were compared against the performance of the lower molecular weight polyethylene glycols, methyl hydroxy propyl cellulose and polyacrylic acid, in TABLE II.

TABLE I

| Example | Formula | Mil Spec[1] % SR[2] | Sanders/ Lambert[9] No. of Strokes[3] | Streaking Filming ΔR[4] |
|---|---|---|---|---|
| 2. | 0.00% PEG[5] 200[6] | 19 | 50 | 5 |
| 3. | 0.10% PEG 200 | 43 | 50 | 6 |
| 4. | 0.15% PEG 200* | 72 | 45 | 7 |
| 5. | 0.20% PEG 200 | 78 | 49 | 6 |
| 6. | 0.25% PEG 200 | 82 | 51 | 6 |
| 7. | 0.30% PEG 200 | 78 | 46 | 8 |
| 8. | 0.15% PEG 200* | 72 | 45 | 7 |
| 9. | 0.15% PEG 8,000 | 71 | 60 | 4 |
| 10. | 0.15% PEG 14,000 | 81 | 68 | 3 |
| 11. | 0.15% PEG 200* | 72 | 45 | 7 |
| 12. | 0.15% PVP[7] 40,000 | 69 | 71 | 3 |
| 13. | 0.15% MHPC[8] 6000 | 88 | 48 | 10 |

[1]Mil Spec: Military Specification Soiling Test.
[2]% SR: Soil Removal measured instrumentally. Higher numbers indicate better performance.
[3]Strokes: Average number of strokes needed to provide total removal by the cleaning composition tested. Lower numbers indicate better performance.
[4]ΔR: Change in reflectance measured instrumentally. Lower numbers indicate better performance.
[5]PEG: Polyethylene glycol.
[6]200: Molecular weight of 200. Any further occurrence of acronym (e.g., "PEG") and number (e.g., "8,000") indicates polymer and molecular weight of the chosen polymer.
[7]PVP: Polyvinyl pyrrolidone.
[8]MHPC: Methyl hydroxy propyl cellulose.
[9]Modified Sanders Lambert Urban Soil Test.
*Examples 4, 8, and 11 are identical.

TABLE II

| Example | 14. | 15. | 16. | 17. | 18. | 19. | 20. | 21. | 22. | 23. | 24. | 25. | 26. | 27 | 28 |
|---|---|---|---|---|---|---|---|---|---|---|---|---|---|---|---|
| 2-butoxyethanol | 3.0 | 3.0 | 3.0 | 3.0 | 3.0 | 3.0 | 3.0 | 3.0 | 3.0 | 3.0 | 3.0 | 3.0 | 3.0 | 3.0 | 3.0 |
| $Na_4$ EDTA | 0.67 | 0.67 | 0.67 | 0.67 | 0.67 | 0.67 | 0.67 | 0.67 | 0.67 | 0.67 | 0.67 | 0.67 | 0.67 | 0.67 | 0.67 |
| NaOH | | | | | | | as needed to pH 12.4 | | | | | | | | |
| | PEG[9] 200 | PEG 6000 | PAA[10] 2000 | PAA 5000 | MHPC[11] 50 | MHPC 6000 | PEG 200 | PEG 6000 | PAA 2000 | PAA 5000 | MHPC 50 | MHPC 6000 | PEG 200 | PEG 200 | PEG 200 |

TABLE II-continued

| Example | 14. | 15. | 16. | 17. | 18. | 19. | 20. | 21. | 22. | 23. | 24. | 25. | 26. | 27 | 28 |
|---|---|---|---|---|---|---|---|---|---|---|---|---|---|---|---|
| Polymer | 0.20 | 0.20 | 0.20 | 0.20 | 0.20 | 0.20 | 0.20 | 0.20 | 0.20 | 0.20 | 0.20 | 0.20 | 0.20 | 0.20 | 0.20 |
| Amine Oxide | 0.42 | 0.42 | 0.42 | 0.42 | 0.42 | 0.42 | 0 | 0 | 0 | 0 | 0 | 0 | 0.42[12] | 0.42[13] | 0.42[14] |
| Sanders/Lampert[1] (Stokes to Remove)[2] | 55 | 57 | 44 | 52 | 48 | 54 | 85 | 66 | 54 | 72 | 80 | 57 | 57 | 41 | 63 |
| Mil Spec[3] (% SR)[4] | 81 | 67 | 75 | 63 | 82 | 84 | 7 | 7 | 3 | 4 | 8 | 17 | 72 | 72 | 84 |
| Streak/Film[5] (ΔR)[6] | 6 | 6 | 4 | 4 | 6 | 4 | 3 | 2 | 2 | 1 | 2 | 3 | 5 | 5 | 5 |
| Viscosity[7] (cps[8] @ 24.6° C.) | 12 | 12 | 12 | 12 | 15 | 24 | 11 | 11 | 10 | 10 | 14 | 20 | 14 | 11 | 12 |

[1]Sanders/Lambert: Modified Sanders Lambert Urban Soil Test.
[2]Strokes to Remove: Average number of strokes needed to provide total removal by the cleaning composition tested. Lower numbers indicate better performances.
[3]Mil. Spec.: Military Specification Soiling Test.
[4]% S.R.: Soil Removal measured instrumentally. Higher numbers indicate better performance.
[5]Streak/Film: Streaking/Filming Test.
[6]ΔR: Change in reflectance measured instrumentally. Lower numbers indicate better performance.
[7]Viscosity: Viscosity measured instrumentally. Lower numbers indicate desired viscosity.
[8]cps: Centipoises = dynes/cm$^2$/sec measure of viscosity measured at 24.6° C.
[9]PEG$^{200}$: Polyethylene glycol with molecular weight of 200. Any further occurrence of acronym (e.g., "PAA 200") indicates chosen polymer and molecular weight thereof.
[10]PAA: Polyacrylic acid.
[11]MHPC: Methyl hydroxy propyl cellulose.
[12]Amine Oxide average chain length = 10 carbons ($CH_3$—$(CH_2)_x$, where x = 9).
[13]Amine Oxide average chain length = 12 carbons ($CH_3$—$(CH_2)_x$, where x = 11).
[14]Amine Oxide average chain length = 14 carbons ($CH_3$—$(CH_2)_x$, where x = 13).

Surprisingly, use of the preferred surfactants in combination with the lower weight polymers resulted in improved results in at least two of the four areas tested: increased cleaning capability (% S.R.), retained substantially constant non-streaking or non-filming values; reduced Sanders/Lambert values; and reduced viscosity.

From review of the data, it surprisingly appears that PEG 200 (Examples 3–8, 11, 14, 26–28) in combination with the N-bearing surfactant showed excellent cleaning performance; retained substantially no streaking or no filming of the surface thus cleaned, even though more solids (polymers) were present; and displayed no substantial rise in viscosity, which was unexpected due to the higher solids content.

Lower molecular weight methyl hydroxy propyl cellulose in conjunction with the N-bearing surfactant (Example 18) also showed improved results in at least two of four assays over the higher weight polymer and N-bearing surfactant. Similarly, low molecular weight polyacrylic acid show surprisingly improved results when combined with the preferred amine oxides (Example 16).

Similar results could be expected for polyvinyl pyrrolidone and other similar polymers below molecular weight 5,000. Such a result would appear to be consistent with the hypothesis that lower molecular weight polymers in combination with an N-bearing surfactant will improve performance surprisingly in at least two areas of cleaning data.

Absence of either polymers or N-bearing surfactant shows what marked improvement the present invention has over the prior art. Examples 20–25, 35 lack amine oxide, or other surfactant and show virtually no cleaning power (% S.R. ranges from 7–17).

A comparison with other cleaning compositions using higher molecular weight (above 5,000) polymers shows that none can claim the improved performance across all four cleaning categories. Example 15, PEG 6000, shows somewhat comparable S/L, Streak/Film, and viscosity values, but much lower Mil. Spec. values (67% S.R. vs. 81% S.R. for Example 14 with PEG 200). MHPC 6000 (Example 19) appears to show somewhat high cleaning (84% S.R.) and low non-streaking values (4), but undesirable viscosity (24) as compared to MHPC 50 (Example 18).

Further advantages of the present invention include lowered cost. Since the lower molecular weight polymers used in the compositions of this invention require a smaller number of monomer units, synthesis of the lower molecular weight polymers is less expensive, and likely faster and easier to obtain. Since the total amount of materials comprising such lower molecular weight polymers is less, this is responsible for the cost savings.

A further embodiment of this invention discloses use of amine oxide surfactants of varying chain lengths. Examples 26–28 show, respectively, average carbon chain lengths of $CH_3$—$(CH_2)_X$, wherein X=9(10 carbons), 11(12 carbons), and 13(14 carbons).

Results of varying chain length of the amine oxide surfactant appear to show that while optimal results in all four cleaning performance areas occur with a preferred N-bearing surfactant, an amine oxide, lauryl dimethyl amine oxide (Example 27), very good results also occur with regard to the 10 and 14 carbon chain amine oxides, and thus, fall within the scope of this invention. Mixtures of varying chain length surfactants also come within the scope of this invention.

Thus, it appears that cleaning compositions of this invention will desirably possess the following performance values in the four cleaning performance areas:

S/L=no more than about 56 strokes

S.R.=at least about 57%

Display substantially no streaking or filming even compared to a base which has no polymer (compare Examples 3–7 with Example 2 in Table I).

Viscosity=no more than about 23 centipoises at a constant temperature of 24.6° C., at 100 RPM, measured on a Brookfield Viscometer Model RVT using a No. 1 Spindle.

TABLE III below depicts the effect of not including in the formulas of this invention either the surfactant or the polymer.

TABLE III

| Example | Formula | Sanders/Lambert[1] No. of Strokes[3] | Mil Spec[2] % SR[4] | Streak Film ΔR[5] |
|---|---|---|---|---|
| 29 | Base[7] + 0.15% PEG 200[6] | 61 | 15 | 10 |
| 30 | Base + .42% Triton N-101[8] | 56 | 58 | 17 |
| 31 | Base + .42% Neodol 25-9[9] | 59 | 28 | 19 |
| 32 | Base + .42% Alkyl Ether[10] Sulfate ($AE_3S$) | 61 | 19 | 6 |
| 33 | Base + .42% Coco Amido[11] Betaine | 57 | 55 | 13 |
| 34 | Base + .42% LAS[12] | 66 | 36 | 7 |
| 35 | Base + .15% PEG 200 + .42% Triton N-101 | 45 | 69 | 21 |
| 36 | Base + .15% PEG 200 + .42% Neodol 25-9 | 48 | 34 | 15 |
| 37 | Base + .15% PEG 200 + .42% Alkyl Ether Sulfate | 45 | 29 | 8 |
| 38 | Base + .15% PEG 200 + .42% Coco Amido Betaine | 37 | 64 | 10 |
| 39 | Base + .15% PEG 200 + .42% LAS | 51 | 65 | 11 |

[1]Sanders-Lambert: Modified Sanders Lambert Urban Soil Test.
[2]Mil Spec: Military Specification Soiling Test.
[3]No. of Strokes: Average number of strokes needed to provide total removal of the cleaning composition tested. Lower numbers indicate better performance.
[4]% S.R.: Soil Removal Measured instrumentally. Higher numbers indicate better performance.
[5]ΔR: Change in reflectance instrumentally. Lower numbers indicate better performance.
[6]PEG 200: Polyethylene glycol with molecular weight of 200.
[7]Base: Base Formula of:
3.0% Butyl Cellosolve
0.67% Na EDTA
0.15% NaOH
balance: water
[8]Triton N-101: Nonylphenoxy polyoxy ethanol.
[9]Neodol 25-9: $C_{12-15}$ alcohol ethoxylate with 9 moles of ethylene oxide per mole of alcohol.
[10]Alkyl Ether Sulfate ($AE_3S$): Alkyl ether sulfate averaging 12 to 14 carbons with a degree of ethoxylation from 1 to 6.
[11]Coco Amido Betaine: a betaine averaging 12 to 14 carbons.
[12]LAS: Sodium dodecyl benzene sulfonate, averaging 12 to 14 carbons, also known as linear alkyl benzene sulfonate, sodium salt.

Still further surprising results appear upon consideration of TABLE III. When the preferred PEG 200 material or a variety of surfactants were tested by themselves, none of the materials provided the desired performance levels. (See Examples 29 to 34; note especially the comparatively poor results in Sanders/Lambert values and Mil Spec values). However, when 0.15% PEG 200 was added to each of the different surfactants (Examples 35 to 39), surprisingly, there was a general trend towards much greater overall cleaning performance as compared to results obtained using either the PEG 200 or any of the surfactants alone. Further, streaking and filming values were not adversely affected despite a higher total solids content. This clearly shows the broad application of low molecular weight polymer addition in a wide range of surfactant types.

The foregoing embodiments are for the purposes of exemplification only, and not intended to restrict in any manner the scope of this invention.

We claim:

1. A substantially non-streaking, aqueous hard surface cleaning compositin comprising:

(a) approximately 0.05% to 25.0% by weight of a $C_{10-14}$ amine oxide or a betaine surfactant;

(b) approximately 0.05% to 25.0% by weight of a polyethylene glycol of molecular weight less than 5,000;

(c) approximately 0.05% to 25.0% by weight of a solvent having the general structure

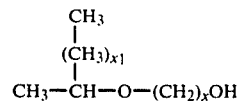

wherein $x_1$ is 0 to 6, and x is 1 to 6;

(d) approximately 0.05% to 25.0% by weight of sodium salts of ethyelen diamine tetraacetic acid; and (e) the remainder as water.

2. A substantially non-streaking, aqueous hard surface cleaning composition comprising:

(a) approximately 0.05% to 25.0% by weight of a $C_{10-14}$ amine oxide or a betaine surfactant;

(b) approximately 0.05% to 25.0% by weight of a polyethylene glycol of molecular weight less than 5,000;

(c) aproximately 0.05% to 25.0% by weight of butoxy ethanol solvent;

(d) approximately 0.05% to 25.0% by weight of tetrasodium ethylene diamine tetraacetate;

(e) sodium hydroxide as needed to yield a pH of at least 8;

(f) the remainder as water.

* * * * *